US007155885B1

(12) United States Patent
Nasiatka et al.

(10) Patent No.: US 7,155,885 B1
(45) Date of Patent: Jan. 2, 2007

(54) SMALL PROFILE STRAPPING TOOL

(75) Inventors: Jason R. Nasiatka, Northbrook, IL (US); Janusz Figiel, Mundelein, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 52 days.

(21) Appl. No.: 11/168,575

(22) Filed: Jun. 28, 2005

(51) Int. Cl.
*B65B 13/24* (2006.01)
*B65B 27/00* (2006.01)

(52) U.S. Cl. ..... 53/582; 53/590; 100/29; 100/32; 100/33 PB

(58) Field of Classification Search ..... 53/582, 53/590, 592; 100/29, 33 R, 33 PB; 156/494, 156/495
See application file for complete search history.

(56) References Cited

U.S. PATENT DOCUMENTS 3,506,041 A * 4/1970 Angarola ..... 140/93.4
3,654,033 A * 4/1972 Angarola et al. ..... 53/582
3,863,684 A * 2/1975 Simmons ..... 140/93.4
4,062,278 A * 12/1977 Cheung ..... 53/582
4,282,907 A * 8/1981 Massion et al. ..... 140/93.4
5,169,480 A * 12/1992 Toppel et al. ..... 156/502
5,380,393 A * 1/1995 Drabarek et al. ..... 100/33 PB
5,476,569 A * 12/1995 Harada ..... 100/33 PB
5,694,749 A * 12/1997 Oseland ..... 53/592
5,853,524 A * 12/1998 Nix ..... 100/33 PB
6,338,375 B1 * 1/2002 Harada ..... 156/502
6,732,638 B1 * 5/2004 Rometty et al. ..... 156/502
6,895,733 B1 * 5/2005 Nix ..... 53/582
6,907,717 B1 * 6/2005 Nix ..... 53/582
6,918,235 B1 * 7/2005 Nix ..... 53/582
6,966,255 B1 * 11/2005 Crittenden ..... 53/582

* cited by examiner

*Primary Examiner*—Louis Huynh
(74) *Attorney, Agent, or Firm*—Mark W. Croll, Esq.; Donald J. Breh, Esq.; Levenfeld Pearlstein, LLC.

(57) ABSTRACT

A small profile strapping tool includes a body defining a cylinder housing, a piston disposed within a cylinder in the cylinder housing, a pneumatic weld motor operably connected to the piston for actuation during a weld cycle, a pneumatic tensioning motor for actuation during a tensioning cycle, and a pneumatic module removably mounted to the cylinder housing. Within the module, a pilot valve controls a flow of gas into the module, a tensioning motor valve controls gas flow to the tensioning motor to draw tension in the strap, a weld cycle valve controls gas flow to the weld motor and piston, a timer and an accumulator are configured to isolate gas flow to the weld motor upon reaching a predetermined pressure in the accumulator following actuation, and a pneumatic signal circuit disposed between the cylinder and a bleed valve includes a signal valve that controls actuation of the bleed valve to route gas to the tension motor to maintain tension in the strap following the weld cycle.

14 Claims, 4 Drawing Sheets

SMALL PROFILE STRAPPING TOOL

BACKGROUND OF THE INVENTION

The present invention pertains to an improved small profile tool for tightening strap around an object or load and adhering the strap onto itself. More particularly, the present invention is directed to a pneumatic circuit and module for a strapping tool that is configured to tension a strap around a load, weld or melt-adhere the strap onto itself and sever the strap from a strap source (e.g., supply).

Strapping tools are well-known in the art. These tools come in a wide variety of types, from fully manual tools to automatic, table-top tools. Tools are generally designed for use with either metal strapping or plastic/polymeric strapping.

Strappers for applying plastic or polymeric strapping materials can be of the automatic table-top or hand-held devices and are either electrically or pneumatically driven. This is necessary in order to provide energy for tensioning the strapping material and adhering the strap onto itself. Typically, the adhering function is provided by melting or otherwise welding a section of the polymeric (plastic) strapping material onto itself. Such melting or welding operations are generally carried out using ultrasonic or vibrational-type weld assemblies. The movement or vibrational motion can be provided by electrical, electromechanical or fluid drive (hydraulic or pneumatic) systems.

In one exemplary tool, a pneumatic system is used to drive the motors to tension the strap (driving a tensioning wheel), and to move a vibrating element that is in contact with interfacial surfaces of overlapping plastic strap portions. The tool includes a pneumatic circuit to route the compressed gas (air) to the appropriate functional elements (clamps and motors) through valves and the like.

In such a tool, the various functional elements are large and as such can be cumbersome. In addition, many such tools use one or more large (and heavy) mechanical clutch (es) to hold or clamp the strap following tension.

Accordingly, there exists a need for a pneumatic strapping tool that uses separate pneumatic motors (one motor for tensioning or feeding strap and another for welding the strap material onto itself) in a small or low profile package. Desirably, such a tool incorporates a pneumatic circuit that allows eliminating the clutch (and thus the weight) otherwise necessary for clamping the strap during welding and roll-back to facilitate operation. Most desirably, for ergonomic considerations, the pneumatic module is of a two button design to facilitate operation and to prevent actuation of the tensioning cycle (motor) during the sealing cycle.

BRIEF SUMMARY OF THE INVENTION

A small profile strapping tool is configured for tensioning a strap around a load, adhering the strap onto itself, and cutting a feed end of the strap. The tool uses separate pneumatic motors (one motor for tensioning or feeding strap and another for welding the strap material onto itself) in a small or low profile package. The tool incorporates a pneumatic circuit that allows eliminating the clutch (and thus the weight) otherwise necessary for clamping the strap during welding and roll-back to facilitate operation.

The pneumatic module is of a two button design to facilitate operation and to prevent actuation of the tensioning cycle (motor) during the sealing cycle. The tool includes a body defining a cylinder housing, a piston disposed within a cylinder in the cylinder housing, a pneumatic weld motor operably connected to the piston for actuation during a weld cycle to adhere the strap onto itself and a pneumatic tensioning motor for actuation during a tensioning cycle to tension the strap prior to adhering the strap onto itself.

The pneumatic module is removably mounted to the cylinder housing and includes a compressed gas inlet to the module and a pilot valve in flow communication with the gas inlet for controlling the flow of compressed gas into the module. A tensioning motor valve controls compressed gas flow to the tensioning motor and a weld cycle valve controls compressed gas flow to the weld motor and piston. The tension motor and the weld motor are in flow communication with (receiving gas from) the pilot valve.

A tensioning motor valve switch (one of the two buttons) actuates the tensioning motor valve to draw tension in the strap. The weld cycle valve switch (the second button) is then depressed to actuate the weld cycle valve and initiate the weld cycle. A timer and an accumulator in parallel with the weld motor are configured to isolate gas flow to the weld motor following actuation of the weld motor valve, upon reaching a predetermined pressure in the accumulator (corresponding to a predetermined amount of time). A pneumatic signal circuit is disposed between the piston cylinder and a bleed valve and includes a signal valve in the signal circuit. The signal valve controls the actuation of the bleed valve to route gas to the tension motor to maintain tension in the strap following the weld cycle during the cooldown cycle, thus eliminating the need for a mechanical clutch in the tensioning motor.

In a preferred strapping tool, the module is self-contained. The timer and the accumulator isolate gas flow to the pilot valve upon reaching a predetermined pressure in the accumulator (again, corresponding to a predetermined period of time). Another timer is disposed between the weld motor and the piston cylinder to delay venting of the piston cylinder following isolation of gas flow into the piston cylinder.

The tensioning motor valve is biased to close the valve to isolate flow to the tension motor and the weld motor valve is biased to close the valve to isolate flow to the weld motor. Compressed gas is introduced to the tension motor valve to assist the bias to close the valve and compressed gas is introduced to the weld motor valve against the bias to maintain the valve in an open condition.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
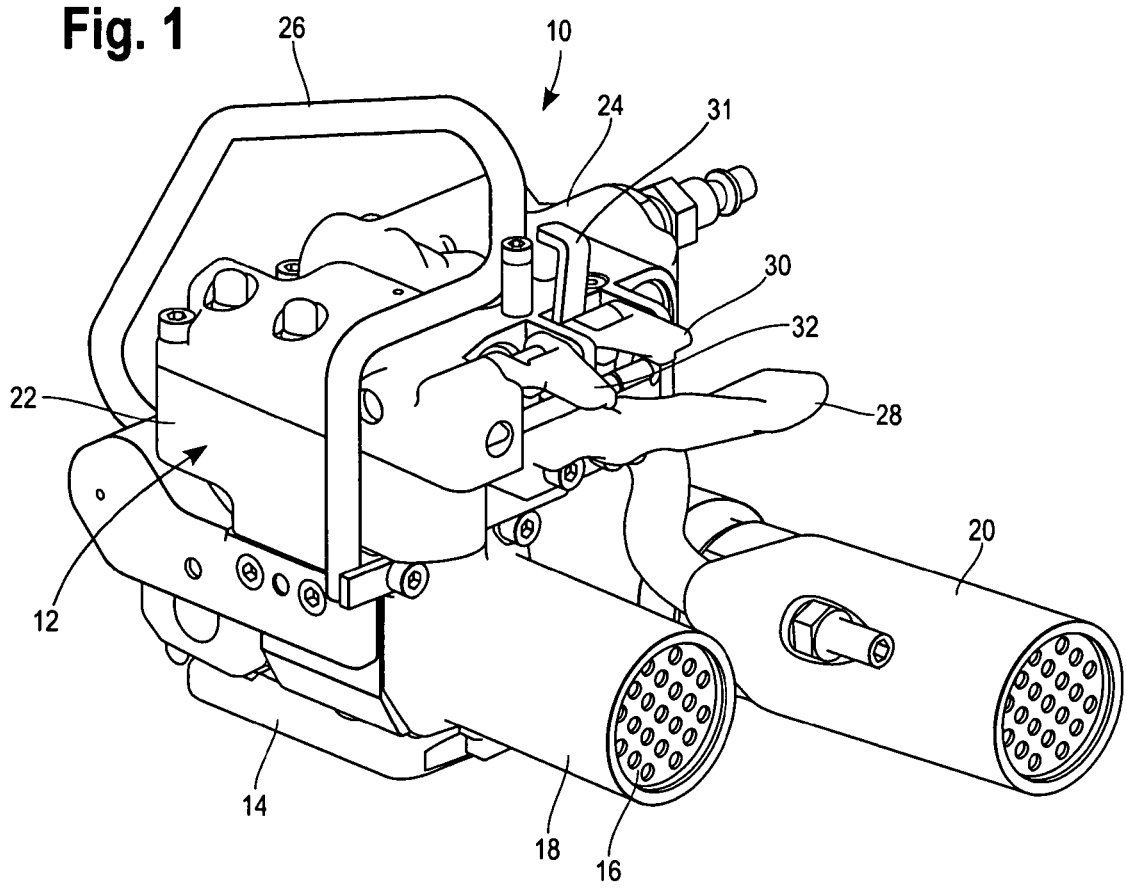
FIG. 1 is a perspective view of an improved small profile strapping tool embodying the principles of the present invention, the tool being shown with a strap material positioned in the tool, and showing the direction of movement of the material during tensioning.
Figure 2:
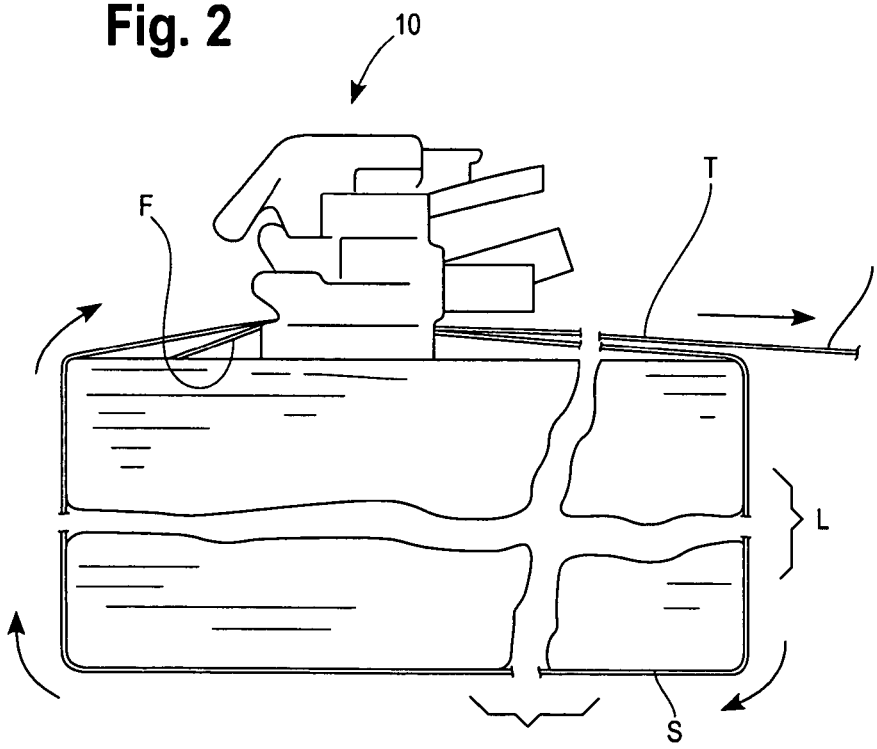
FIG. 2 is a schematic illustration of the tool on a load to be strapped, with the strap material encircling the load.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a pneumatic motor strapper or strapping tool 10 of a design similar to that of the present invention. The illustrated strapper 10 shows, generally, the construction of a strapping tool that is configured to tension a strap S around a load L, weld the strap S material onto itself and sever a feed end F of the strap. For purposes of the present disclosure, the strap material will be referred to as having a feed end F which is the supply end of the material and a free or trailing end T which is that end of the material that is fed around the load L and reinserted into the strapping tool 10 for welding.

The tool includes, generally, a body 12, a foot 14, a weld motor 16 and housing 18, a tensioning motor 20, a cylinder housing 22 and a pneumatic module 24 having a circuit embodying the principle of the present invention. The tool 10 includes a handle 26 and grip 28 for ease of handling and use. The pneumatic module 24, as will be discussed in more detail below, is mounted to the body 12 and provides pneumatic pathways between the module 24 and the weld and tensioning motors 16, 20 for introducing and venting a compressed gas, such as compressed air, to and from the motors. The module 24 is readily mounted to and removed from the body 12 by a plurality of fasteners such as bolts and the like.

The pneumatic module 24 is removably mounted to the body 12 and includes a plurality of components (e.g., switches, such as tension motor switch 30 and weld motor switch 32, valves, accumulators) to control the overall operation of the strapper 10. The module 24 is configured to readily mount to and be removed from the body 12 by, for example, bolts or like fasteners for ease of maintenance, removal and repair. In this manner, the module 24 can be removed and a spare installed on the tool 10 for continued use.

Figure 3:
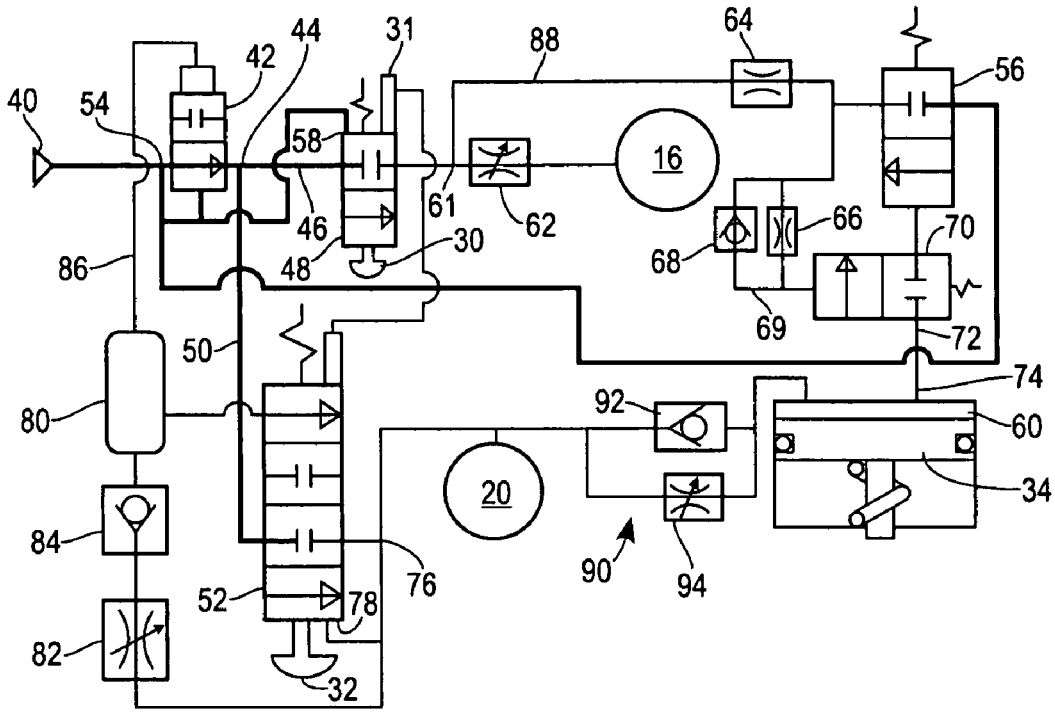
FIG. 3 is a pneumatic circuit diagram illustrating the pressurized lines (in bold) when the tool is in a neutral state.

Referring to FIG. 3, a pneumatic schematic is shown in which the tool 10 is in a neutral state. Air enters the tool 10 through a compressed air supply 40 and enters a pilot valve 42. The pilot valve 42 is a two position valve (on-off) that is biased to the on position (as shown). The on position routes air to a juncture 44 at which the air supply splits with one branch 46 routing air to a tension motor valve 48 and the other branch 50 routing air to a weld cycle valve 52. A tee 54 in the air supply, prior to the pilot valve 42 is routed to a bleed valve 56 and is routed to a back end of the tension valve (as indicated at 58). The bleed valve 56, as set forth below is used to bleed air to the tension motor 16 during welding and cooling. In the neutral position, air flows to the tension 48 and weld cycle 52 valves and to the bleed valve 56; however, the tension and weld cycle valves 48, 52 and the bleed valve 56 are all in the closed position and thus the system is pressurized.

Figure 4:
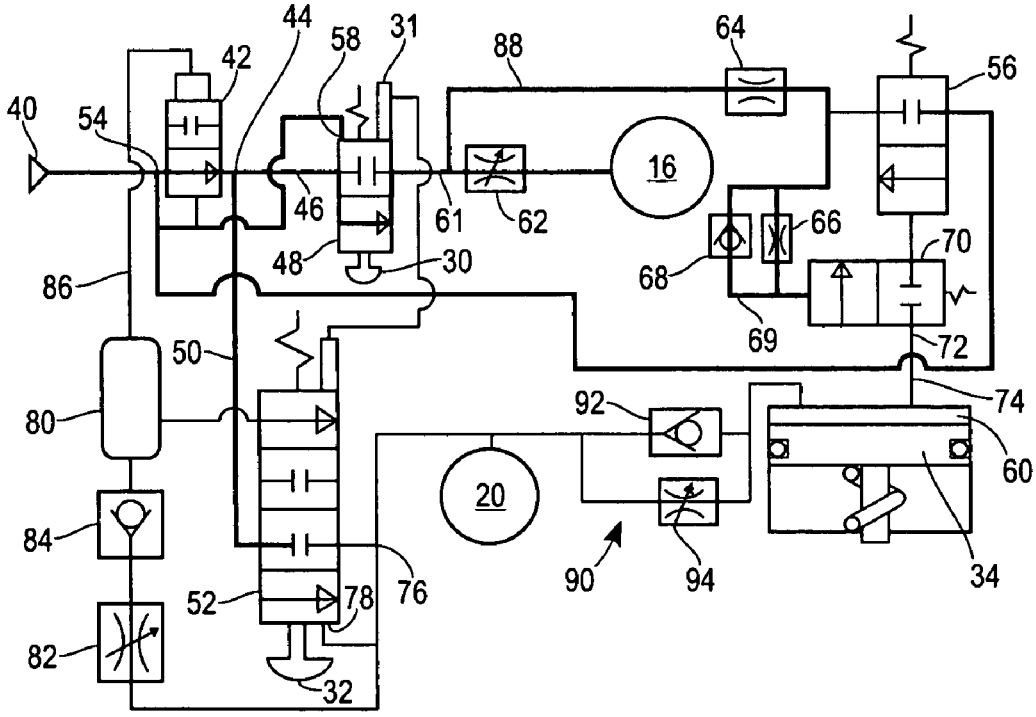
FIG. 4 is the pneumatic circuit diagram illustrating the pressurized lines (in bold) when the tool is in tension mode.

Referring to FIG. 4, depressing or actuating the tensioning motor switch 30 moves the tensioning motor valve 48 into the open position, routing air through a variable orifice 62 to the tensioning motor 16. Referring briefly to FIG. 1, a pivoting latch 31 is positioned between the tension and seal valve motor switches 30, 32 that pivots to lock the tension motor valve 48 in the actuated position and releases the tension motor valve upon actuation, e.g., depression of, the weld motor switch 32. The variable orifice 62 is adjustable to provide control of the tensioning motor 16 power output. Note that the tensioning motor valve 48 is shown in the off or closed position, and is biased to this position. At the same time, air is routed from a tee 61 between the tensioning valve 48 and the tension adjusting orifice 62 to a signal valve orifice 64 in series with an orifice 66 and check valve 68 that route air to a signal valve 70. The signal valve 70 resides in an air line 72 between the piston chamber 60 and the bleed valve 56 and serves to allow or not allow a signal to open or close the bleed valve 56 dependent upon the pressure in the piston chamber 60. The air routed from the tension portion of the system does not flow through the signal valve 70 proper, but moves the signal valve 70 to the open position (against a bias) to provide a signal flow path from the piston chamber 60 to open and close the bleed valve 56. The signal flow (path) is used to move the bleed valve to the open position (also against a bias). This routes air to the tensioning motor 16 to maintain tension in the strap during the weld cycle (as seen in FIG. 5).

Releasing the tensioning motor switch 30 closes the tensioning motor valve 48, terminating the air feed to the tensioning motor 16. The air entering the back end of the tensioning motor valve (at 58) assists (the spring bias) in moving the tensioning valve 48 to the closed position following release of the valve switch 30. At this point in time, however, even though the tensioning motor 16 has stopped (the tensioning valve 48 is closed), a portion of the tensioning portion of the system remains pressurized with air routed to the signal valve 70 to maintain the signal valve in the open position as long as there is sufficient pressure in the line 69 between the orifice 66 and the signal valve 70.

Figure 5:
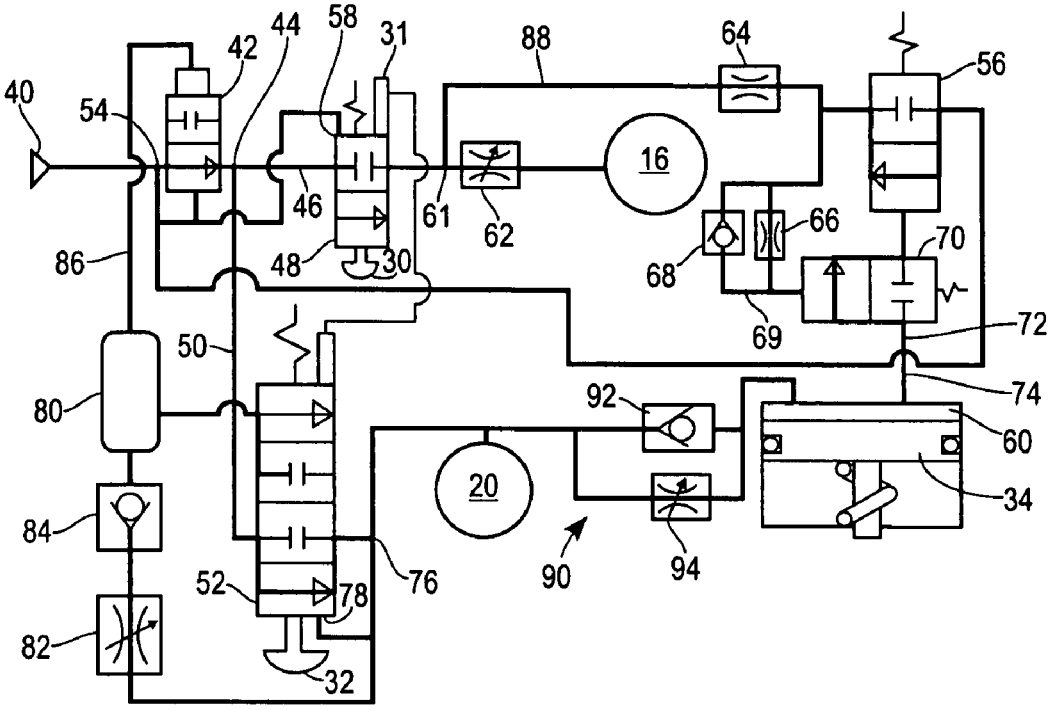
FIG. 5 is the pneumatic circuit diagram illustrating the pressurized lines (in bold) when the tool is in weld mode after tensioning.

Referring to FIG. 5, a weld cycle switch 32 operates the weld cycle valve 52. Depressing the switch 32 moves the valve 52 to the on position. (Note that the valve is shown in the off or closed position and is biased to this position.) The weld cycle valve 52 is a contact or maintain valve. In the on position, air is routed through the second line branch 50 to the valve 52. Air enters the valve 52 and is routed to the weld motor 20. A line tee 76 from the weld motor line is routed back to the weld cycle valve (at 78) to "hold" the valve 52 in the on position. Although the valve 52 is biased to the closed position, the air pressure "holding" the valve 52 open is sufficiently high to overcome the spring force.

Figure 6:
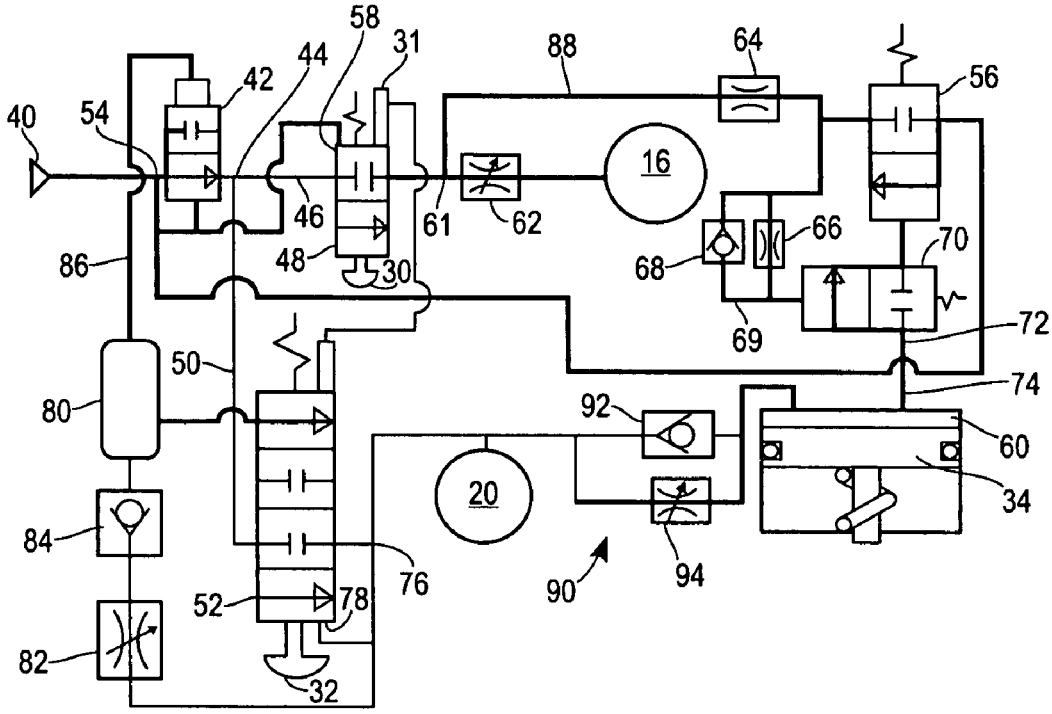
FIG. 6 is the pneumatic circuit diagram illustrating the pressurized lines (in bold) when the tool is in cooldown mode after tensioning and welding.

As air is provided to the weld motor 20, air is also routed to the weld cylinder 60 (to the top of the piston) to maintain pressure on the piston 34 (which assures that sufficient pressure is applied by the weld element on the strap S). The air is routed to the top of the weld cylinder 60 through a check valve 92. As set forth above, after welding is complete, the strap S must be allowed sufficient time to cool to assure integrity of the weld. Cool down, which is shown schematically in FIG. 6, is accomplish with pressure applied by the weld element on the strap S (by applying pressure via the piston 34), without the vibrational motion of the element being imparted.

In addition, as air is routed to the piston chamber 60 (weld piston chamber), air also flows through the signal line 72 and the signal valve 70 to in turn open the bleed valve 56 which routes air back to the tension motor 16 to maintain tension (not further tension) in the strap during welding and to signal valve 70 to maintain its open position.

At the same time that air is routed to the weld motor 20 and piston chamber 60, air is directed to a volume chamber or accumulator 80, through a weld timer 82 and check valve 84 for weld timing. The weld timer 82 is a restriction device such as the illustrated variable orifice. In this manner, air flow into the accumulator 80 is restricted (and thus timed) in that flow through the orifice 82 is limited or restricted. A line 86 from the accumulator 80 is routed to the pilot valve, so that as the pressure in the accumulator 80 increases, air flows to the pilot valve 42. When the air in the accumulator 80 reaches a predetermined pressure, the pilot valve 42 closes, thus stopping air flow to the weld cycle valve 52. This stops operation of the weld motor 20.

When air flow is terminated to the weld cycle valve 52, the pressure exerted to maintain the valve 52 open (through line 78) also drops, and the valve 52 returns to the closed position by action of the bias.

Referring to FIG. 6, the cool down timer 90 maintains pressure on the piston 34 without vibrational motion of the weld element, which is accomplished by isolating air to the weld motor 20 (thus ceasing vibration). The air routed to the top of the weld cylinder 60 is slowly vented from the cylinder 60 by a restricted vent path from the top of the cylinder 60. The cool down timer includes a check valve 92 in parallel with a restriction device 94 such as a variable orifice. In this manner, although the weld motor 20 has stopped, the pressure exerted by the piston 34 is maintained and is slowly released by the timed venting from the cylinder 60. In addition, during cool down, the air pressure holding the bleed valve 56 also declines (in a slow, timed manner by action of restricted flow through orifice 94) allowing the bleed valve 56 to return to the closed position. This in turn isolates air flow through line 88 to the tension motor 16 and the signal valve 70 which in turn is urged closed. In addition, the volume chamber 80 is vented through seal valve 52 allowing the pilot valve 42 to reset to the open position.

Figure 7:
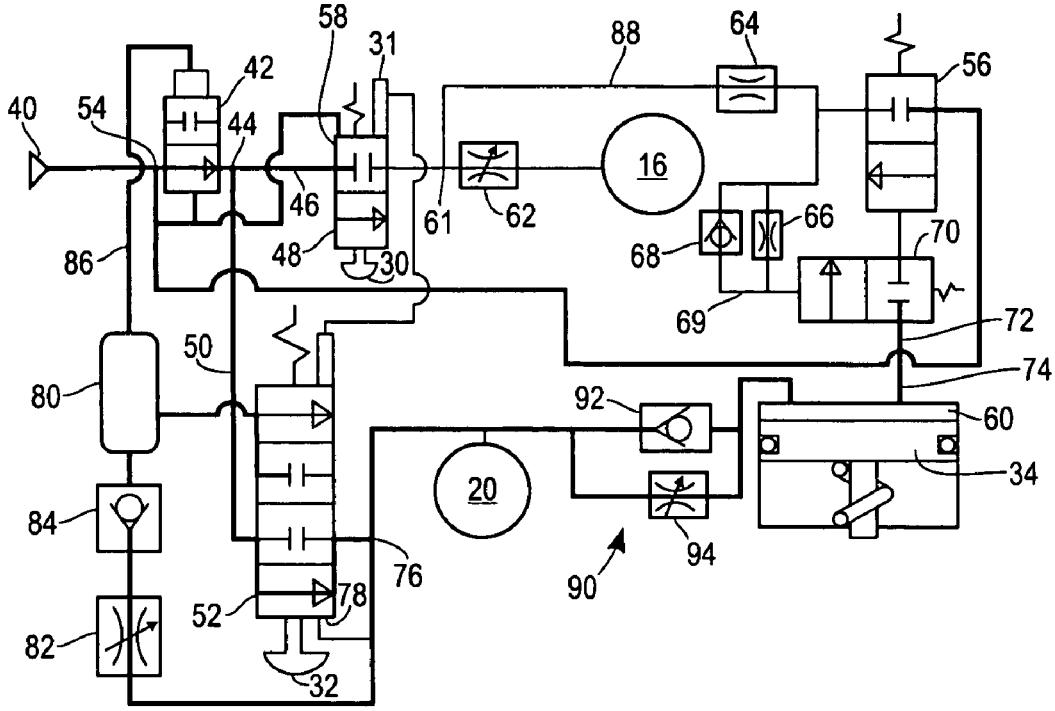
FIG. 7 is the pneumatic circuit diagram illustrating the pressurized lines (in bold) when the tool weld mode is actuated without tensioning.

One of the advantages of the present system is the "fail-safe" mode of operation seen in FIG. 7, in which nothing occurs (that is, no tensioning) when the weld cycle valve 52 is actuated without first actuating the tensioning cycle valve. This also prevents inadvertently actuating the tensioning motor 16 during the weld cycle.

Figure 8:
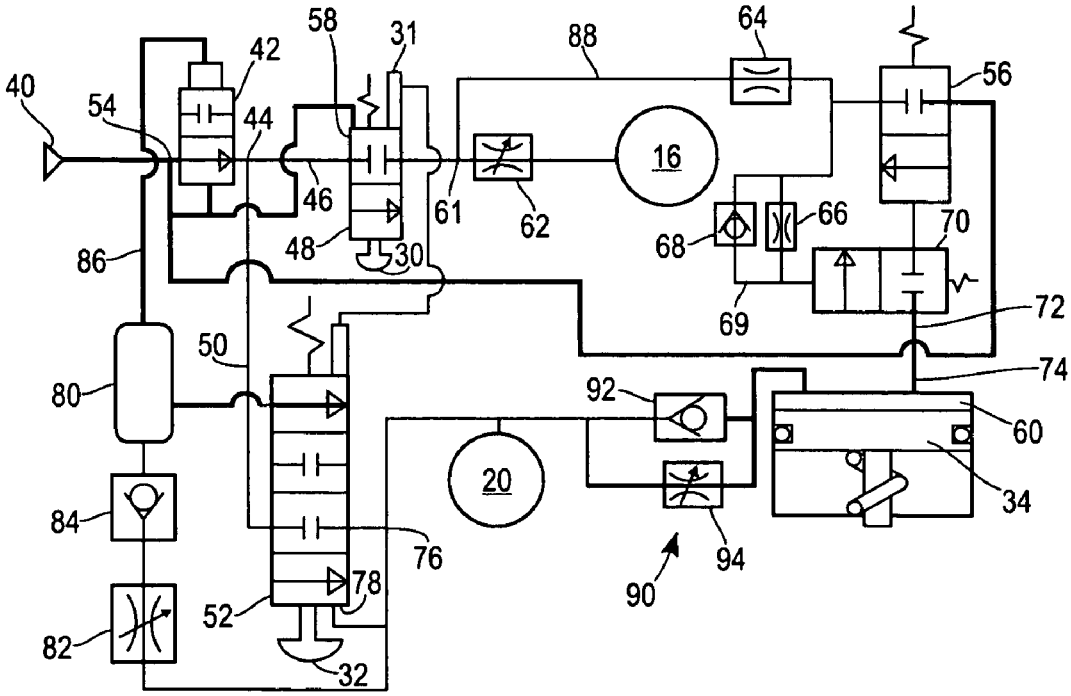
FIG. 8 is the pneumatic circuit diagram illustrating the pressurized lines (in bold) when the tool is in cooldown mode after welding and without tension in the strap.

FIG. 8 illustrates the cooldown cycle without strap tension (air is isolated from the tension motor 16). In this mode, air is isolated from the weld motor 20 and is bled from the piston 60 through orifice 94.

Continuing through the pneumatic circuit, the accumulator 80 is routed to the pilot valve 42 to close the pilot valve 42 when the accumulator 80 is under pressure. The accumulator 80 vents through the weld cycle valve 52 when the valve is in the off position. The pilot valve 42 is maintained in the open position by a line that tees from the tee line to the weld cycle valve.

Those skilled in the art will recognize and understand that the various references to "lines", "vent paths" and the like are provided by a plurality of openings formed, e.g., machined, in the module.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping tool for tensioning a strap around a load, adhering the strap onto itself, and cutting a feed end of the strap, comprising:

a body defining a cylinder housing;

a piston disposed within a cylinder in the cylinder housing;

a pneumatic weld motor operably connected to the piston for actuation during a weld cycle to adhere the strap onto itself;

a pneumatic tensioning motor for actuation during a tensioning cycle to tension the strap prior to adhering the strap onto itself; and a pneumatic module removably mounted to the cylinder housing, the pneumatic module having a compressed gas inlet to the module, a pilot valve in flow communication with the gas inlet for controlling the flow of compressed gas into the module, a tensioning motor valve for controlling compressed gas flow to the tensioning motor, a weld cycle valve for controlling compressed gas flow to the weld motor, a timer and an accumulator in parallel with the weld motor and configured to isolate gas flow to the weld motor upon reaching a predetermined pressure in the accumulator, a tensioning motor valve switch for actuating the tensioning motor to draw tension in the strap, and a pneumatic signal circuit disposed between the cylinder and a bleed valve, the pneumatic signal circuit including a signal valve, wherein actuation of the tensioning motor valve switch actuates the tensioning motor to draw tension in the strap and subsequent actuation of the weld cycle valve initiates the weld cycle to adhere the strap onto itself, and wherein the signal valve controls movement of the bleed valve to route gas to the tensioning motor to maintain tension in the strap following the weld cycle and to release tension in the strap in a timed manner.

2. The strapping tool in accordance with claim 1 including a weld cycle switch for actuating the weld cycle valve and a tensioning motor switch for actuating the tensioning motor valve.

3. The strapping tool in accordance with claim 1 wherein the module is self-contained.

4. The strapping tool in accordance with claim 1 wherein the timer and the accumulator isolate gas flow to the pilot valve upon reaching a predetermined pressure in the accumulator.

5. The strapping tool in accordance with claim 1 including a timer disposed between the weld motor and the piston cylinder to delay venting of the piston cylinder following isolation of gas flow into the piston cylinder.

6. The strapping tool in accordance with claim 1 wherein the tensioning motor valve is biased to close the valve to isolate flow to the tensioning motor, and wherein compressed gas is introduced to the tensioning motor valve to assist the bias to close the valve.

7. The strapping tool in accordance with claim 1 wherein the weld cycle valve is biased to close the valve to isolate flow to the weld motor, and wherein compressed gas is introduced to the weld cycle valve against the bias to maintain the valve in an open condition.

8. A pneumatic module for a strapping tool for tensioning a strap around a load, adhering the strap onto itself, and cutting a feed end of the strap, the strapping tool having a cylinder housing, a piston disposed within a cylinder in the cylinder housing, a pneumatic weld motor operably connected to the piston for actuation during a weld cycle to adhere the strap onto itself, a pneumatic tensioning motor for actuation during a tensioning cycle to tension the strap prior to adhering the strap onto itself, the pneumatic module comprising:

a body removably mounted to the cylinder housing;

a compressed gas inlet carried by the body;

a pilot valve in flow communication with the gas inlet for controlling the flow of compressed gas into the module;

a tensioning motor valve for controlling compressed gas flow to the tensioning motor;

a weld cycle valve for controlling compressed gas flow to the weld motor;

a timer and an accumulator in parallel with the weld motor and configured to isolate gas flow to the weld motor upon reaching a predetermined pressure in the accumulator;

a tensioning motor valve switch for actuating the tensioning motor to draw tension in the strap; and a pneumatic signal circuit disposed between the cylinder and a bleed valve, the pneumatic signal circuit including a signal valve, wherein actuation of the tensioning motor valve switch actuates the tensioning motor to draw tension in the strap and subsequent actuation of the weld cycle valve initiates the weld cycle to adhere the strap onto itself, and wherein the signal valve controls movement of the bleed valve to route gas to the tensioning motor to maintain tension in the strap following the weld cycle and to release tension in the strap in a timed manner.

9. The pneumatic module in accordance with claim 8 including a weld cycle switch for actuating the weld cycle valve and a tensioning motor switch for actuating the tensioning motor valve.

10. The pneumatic module in accordance with claim 8 wherein the module is self-contained.

11. The pneumatic module in accordance with claim 8 wherein the timer and the accumulator isolate gas flow to the pilot valve upon reaching a predetermined pressure in the accumulator.

12. The pneumatic module in accordance with claim 8 including a timer disposed between the weld motor and the piston cylinder to delay venting of the piston cylinder following isolation of gas flow into the piston cylinder.

13. The pneumatic module in accordance with claim 8 wherein the tensioning motor valve is biased to close the valve to isolate flow to the tensioning motor, and wherein compressed gas is introduced to the tensioning motor valve to assist the bias to close the valve.

14. The pneumatic module in accordance with claim 8 wherein the weld cycle valve is biased to close the valve to isolate flow to the weld motor, and wherein compressed gas is introduced to the weld cycle valve against the bias to maintain the valve in an open condition.

* * * * *